US008499815B2

(12) United States Patent
Zhang

(10) Patent No.: US 8,499,815 B2
(45) Date of Patent: Aug. 6, 2013

(54) LOUVER TURNING MECHANISM AND HOLLOW GLASS DOORS OR WINDOWS WITH BUILT-IN MAGNETICALLY CONTROLLABLE LOUVER

(75) Inventor: Gongchun Zhang, Guangzhou (CN)

(73) Assignee: Cmech (Guangzhou) Industrial Ltd. (CN)

( * ) Notice: Subject to any disclaimer, the term of this patent is extended or adjusted under 35 U.S.C. 154(b) by 38 days.

(21) Appl. No.: 13/209,687

(22) Filed: Aug. 15, 2011

(65) Prior Publication Data

US 2012/0240469 A1 Sep. 27, 2012

(30) Foreign Application Priority Data

Mar. 25, 2011 (CN) ..... 2011 1 0073248

(51) Int. Cl.
*E06B 9/303* (2006.01)

(52) U.S. Cl.
USPC ..... 160/176.1 R; 160/107; 160/177 R

(58) Field of Classification Search
USPC ..... 160/107, 176.1 R, 177 R; 254/4 R, 254/4 B
See application file for complete search history.

(56) References Cited

U.S. PATENT DOCUMENTS

| | | | | |
|---|---|---|---|---|
| 4,768,576 | A * | 9/1988 | Anderson | 160/107 |
| 6,308,764 | B1 * | 10/2001 | Lin | 160/177 R |
| 6,601,633 | B2 * | 8/2003 | Sun et al. | 160/107 |
| 7,082,982 | B2 * | 8/2006 | Eveland et al. | 160/107 |
| 7,475,715 | B2 * | 1/2009 | Gardner et al. | 160/107 |
| 7,543,623 | B2 * | 6/2009 | Allardyce et al. | 160/107 |
| 7,669,633 | B2 * | 3/2010 | Berger | 160/107 |
| 8,251,119 | B2 * | 8/2012 | Toti et al. | 160/168.1 R |
| 8,256,489 | B2 * | 9/2012 | Berger | 160/107 |
| 2004/0200583 | A1 * | 10/2004 | Nien | 160/177 R |
| 2004/0211528 | A1 * | 10/2004 | Jin et al. | 160/107 |
| 2006/0118250 | A1 * | 6/2006 | Jin et al. | 160/107 |
| 2006/0130980 | A1 * | 6/2006 | Gromotka et al. | 160/107 |
| 2006/0151129 | A1 * | 7/2006 | Van Klompenburg et al. | 160/107 |
| 2008/0029226 | A1 * | 2/2008 | Huang | 160/107 |
| 2008/0083511 | A1 * | 4/2008 | Hung | 160/168.1 R |
| 2008/0283200 | A1 * | 11/2008 | Hummel et al. | 160/107 |
| 2010/0243177 | A1 * | 9/2010 | Berger | 160/107 |
| 2011/0094687 | A1 | 4/2011 | Fraser et al. | |
| 2012/0031570 | A1 * | 2/2012 | Ding | 160/127 |
| 2012/0061031 | A1 * | 3/2012 | Zhang | 160/107 |

FOREIGN PATENT DOCUMENTS

| | | |
|---|---|---|
| CN | 1641183 | 7/2005 |
| CN | 201747212 | 2/2011 |

* cited by examiner

*Primary Examiner* — Katherine Mitchell
*Assistant Examiner* — Johnnie A Shablack
(74) *Attorney, Agent, or Firm* — Schmeiser, Olsen & Watts, LLP

(57) ABSTRACT

A louver turning mechanism and a hollow glass door or window with a built-in magnetically controllable louver, comprising a turn traction member, a turn transmission member and a slat turning member which are connected in turn, wherein the turn transmission member comprises a slat turning wheel and a joint interlocking mechanism which are used in cooperation, the joint interlocking mechanism is, at one end thereof, eccentrically fixedly connected to the slat turning wheel to drive it to rotate, and, at the other end thereof, connected to the turn traction member through a connecting push rod; the slat turning wheel is coaxially fixedly connected to a horizontal rotation shaft of the slat turning member is provided.

9 Claims, 6 Drawing Sheets

LOUVER TURNING MECHANISM AND HOLLOW GLASS DOORS OR WINDOWS WITH BUILT-IN MAGNETICALLY CONTROLLABLE LOUVER

FIELD OF TECHNOLOGY

The following relates to a louver and a door or window, and particularly to an embodiment of a louver turning mechanism and a hollow glass door or window with a built-in magnetically controllable louver using the louver turning mechanism.

BACKGROUND

For environment-friendly and energy-saving purposes, hollow glass is currently applied extensively worldwide because of unique characteristics such as heat insulation, sound insulation, and resistance against window frost and against dust pollution. Those having ordinary skill in the art begin to develop and research a kind of hollow glass device with a louver sandwiched between the hollow glass, and the hollow glass device can not only achieve the object of light adjustment and sunshade, but also keep the louver permanently clean and free of cleaning. However, there is a drawback with the louver of the current hollow glass device, that is, a louver turning mechanism and a louver elevating mechanism both employ a cord as a transmission member. Because the cord is made of a soft material, it is susceptible to deformation and extension and even loosening after long-term use, as a result the turning and elevation of the louver cannot be accurately and quickly and effectively controlled, which limits its spread and use of the hollow glass device.

The slat turning mechanism of the prior-art hollow glass door or window with a built-in magnetically controllable louver still usually employs a cord, a beaded cord or synchronous belt as a slat turning and controlling mechanism, which has main drawbacks such as a short service life, unreliable operation and high costs. To solve the above problems, a turn transmitting member is modified for example as in the Chinese patent No. 201020289432.6, wherein members such as a transmission gear train, a transmission rack and a connecting push rod are used for transmission so that the louver turning action is more accurate and quicker. However, when gear transmission is used for a large-area door or window, there are still issues such as undue slat-turning angle, an undesirable shielding performance and heavy slat-turning operation. Because a user has more and more higher requirements for larger-area louver doors or windows, the prior art hollow glass door or window restrains development of large-sized louver doors or windows.

SUMMARY

A first aspect overcomes drawbacks and shortcomings in the prior art and to provide an improved louver-turning mechanism which can meet technical requirements for turning a large-sized louver and substantially improves reliability.

Another aspect is to provide a hollow glass door or window with a built-in magnetically controllable louver using the louver turning mechanism.

Another aspect relates generally to an improved louver turning mechanism comprises a turn traction member, a turn transmission member and a slat turning member which are connected in turn, wherein the turn transmission member comprises a slat turning wheel and a joint interlocking mechanism which are used in cooperation, wherein the joint interlocking mechanism is, at one end thereof, eccentrically fixedly connected to the slat turning wheel to drive it to rotate, and, at the other end thereof, connected to the turn traction member through a connecting push rod; the slat turning wheel is coaxially fixedly connected to a horizontal rotation shaft of the slat turning member.

The joint interlocking mechanism comprises more than one movable joint.

The movable joint is comprised of two hinged joint members.

Two adjacent joint members are respectively provided with a convex portion and a concave portion which cooperate in use, and are engaged with each other and hinged together via a pin.

On an inner side of the movable joint is provided with a frictional surface increasing a friction force when the inner side contacts with the slat turning wheel.

The slat turning wheel comprises two circumferentially provided flanges, and an end of the joint interlocking mechanism is fixedly connected between the two flanges.

An improved hollow glass door or window with a built-in magnetically controllable louver comprises two layers of glass, a louver sandwiched between the two layers of glass, and a frame sealing and connecting the two layers of glass, wherein a louver lift mechanism and a louver turning mechanism is provided in the frame.

The louver lift mechanism comprises a lift pull cord, and a rolling bearing assembly is disposed on a straight travel path and/or at a corner of the lift pull cord.

The rolling bearing assembly comprises a rolling pin and a ball bearing, or comprises a rolling pin, a ball bearing and a plastic bearing sleeve.

The louver lift mechanism comprises a counterweight on one side of which a wearable plastic stud is disposed.

According to the present invention, the slat turning wheel and the joint interlocking mechanism are used in cooperation to substitute a pull-cord transmission mechanism and a gear transmission mechanism. The present invention is structurally more compact and reasonable. The louver can act more precisely and reliably and be turned at a larger angle so that the slats of the louver can abut against one another more closely. The louver exhibits advantages such as a better sunshade performance, a longer service life, stable and reliable use, unlikelihood to deformation and a light hand feeling in the slat-turning operation. Meanwhile, heavier slats can be turned so that a larger area of louver can be manufactured, whereby a limitation of area of the prior-art louver is broken through and hollow glass doors and windows can be further spread and used in more broad fields.

To make the present invention more clearly comprehensible, preferred embodiments of the present invention will be described with reference to the drawings.

DETAILED DESCRIPTION

Figure 1:
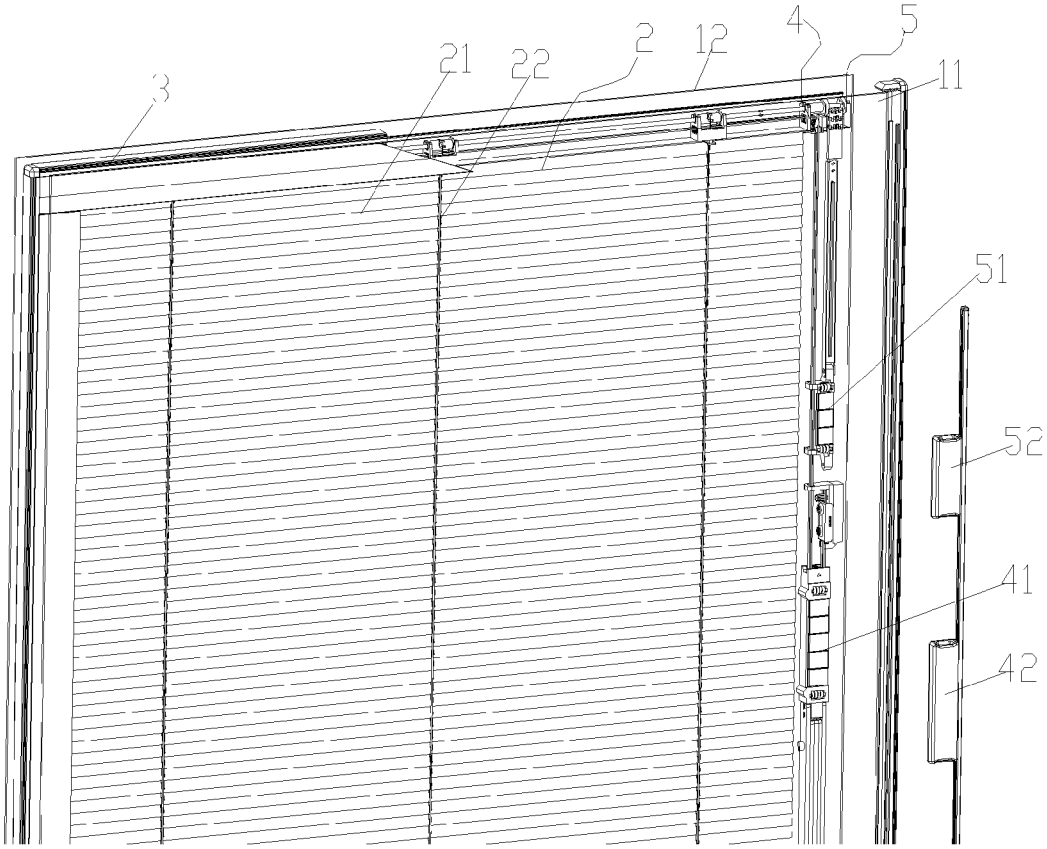
FIG. 1 is a schematic view showing an embodiment of a hollow glass door or window having an embodiment of a lover mechanism in a state in which slats are turned downwardly.
Figure 2:
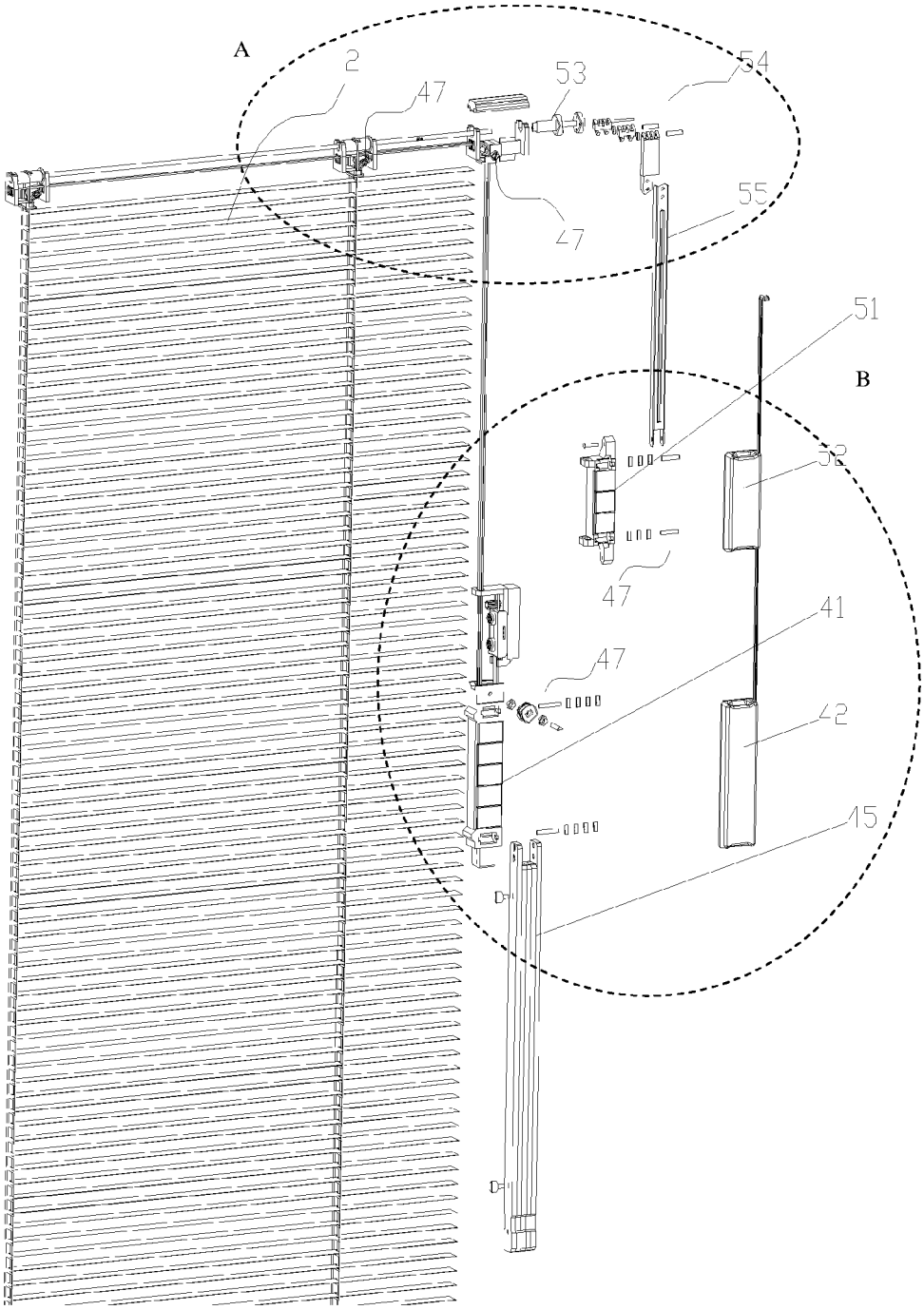
FIG. 2 is an exploded view of an embodiment of the louver mechanism.

The following description of an embodiment of a louver mechanism provides an improved louver turning mechanism which can be applied to products such as a window shade, doors or windows with a built-in louver. Embodiments of the louver mechanism are illustrated by taking hollow glass doors or windows with a built-in magnetically controllable louver as an example.

As shown in FIGS. 1-4, an improved hollow glass door or window with a built-in magnetically controllable louver comprises an inner glass layer 11, an outer glass layer 12, a louver 2 sandwiched between the inner and outer glass layers, and a frame 3 sealing and connecting the inner and outer glass layers, wherein the louver 2 is formed by a plurality of slats 21 connected by a turning cord 22 in series, and a louver lift mechanism 4 and a louver turning mechanism 5 is provided in the frame 3.

The louver turning mechanism 5 comprises a turn traction member, a turn transmission member and a slat turning member which are connected in turn.

The turn traction member comprises a turn traction magnet inner slide assembly 51 and a turn traction magnet outer slide assembly 52, wherein the turn traction magnet inner slide assembly 51 is provided in a frame 3 column and the turn traction magnet outer slide assembly 52 is provided outside the frame 3 column and located corresponding to and cooperating with the turn traction magnet inner slide assembly 51.

Figure 3:
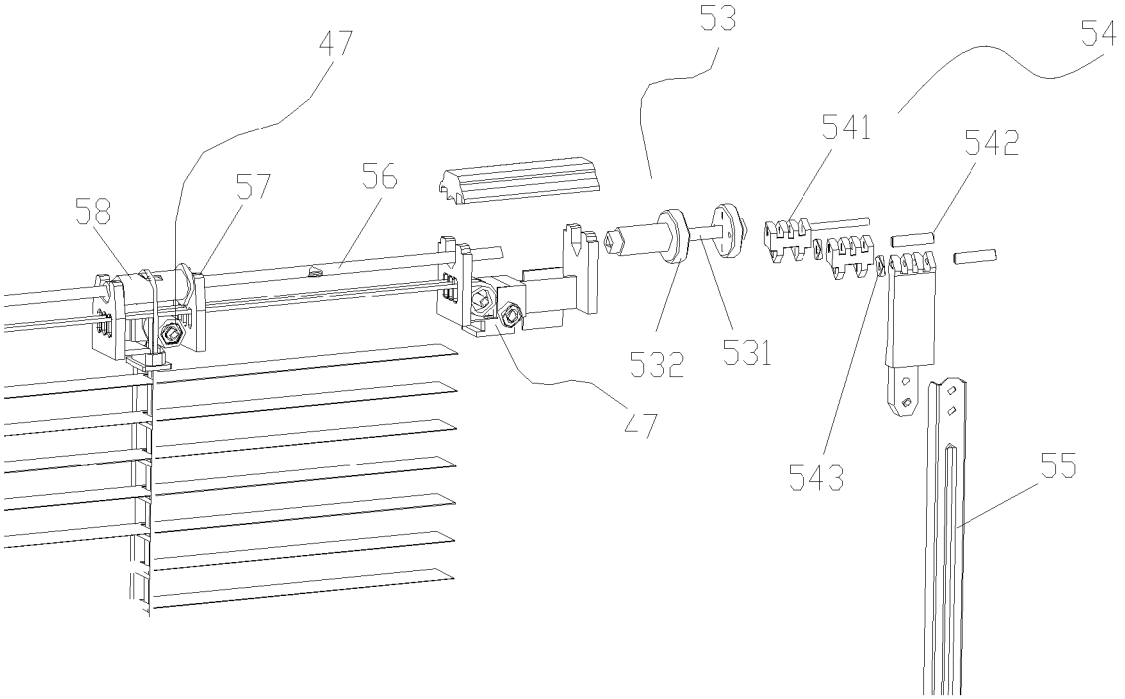
FIG. 3 is a partial enlarged view of portion A of FIG. 2.
Figure 4:
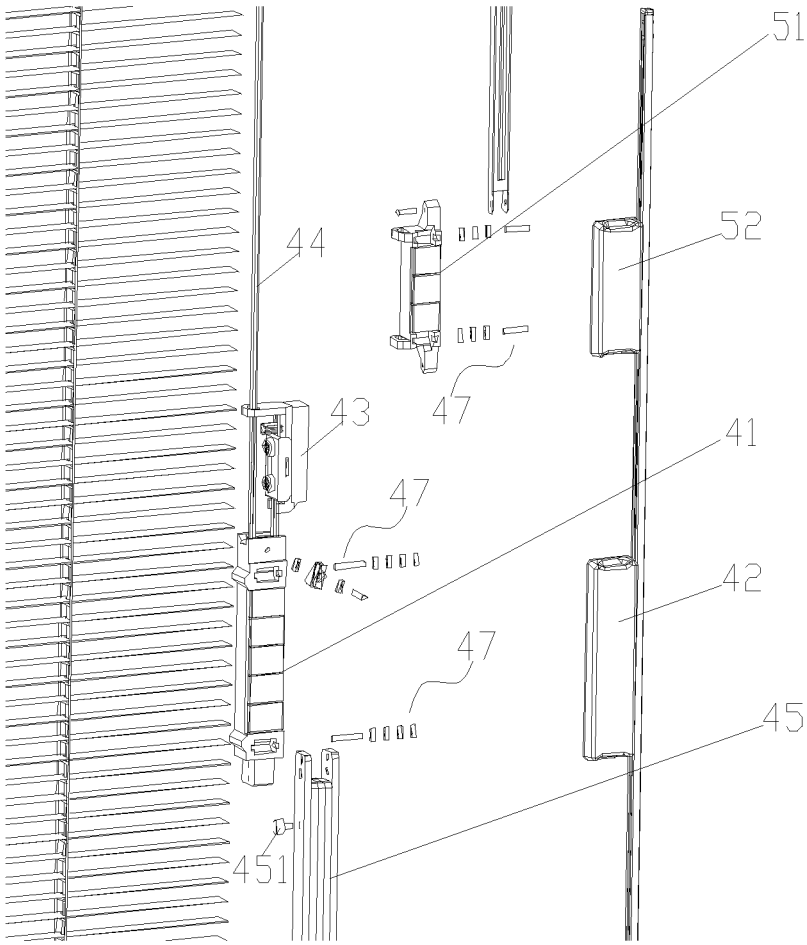
FIG. 4 *s* a partial enlarged view of portion B of FIG. 2.

The turn transmission member comprises a slat turning wheel 53 and a joint interlocking mechanism 54 which are used in cooperation, wherein the joint interlocking mechanism 54 is, at one end thereof, eccentrically fixedly connected to the slat turning wheel 53 to drive it to rotate, and, at the other end thereof, connected to the turn traction member through a connecting push rod 55; the slat turning wheel 53 is coaxially fixedly connected to a horizontal rotation shaft 56 of the slat turning member. The joint interlocking mechanism 54 comprises more than one movable joint so as to perform a bending action. In the present embodiment, there are provided two movable joints. Each of the movable joints is comprised of two hinged joint members 541. Two adjacent joint members 541 are respectively provided with a convex portion and a concave portion which cooperate in use, and are engaged with each other and hinged together via a pin 542. At a head portion of the joint member at the foremost end is provided with a mounting hole, and the joint member is articulated with the slat turning wheel 53 via the pin 542. At a tail portion of the joint member at the rearmost end is provided a connecting portion which is fixedly connected to the connecting push rod 55. Preferably, on an inner side of the movable joint is provided a frictional surface increasing a friction force when the inner side contacts with the slat turning wheel. In one embodiment, on the inner side of the joint member 541 is provided a coarse surface for forming a frictional surface, or as shown in FIG. 3, where the joint member 541 is articulated, a friction disc 543 or a friction wheel is fixed via the pin 542, thereby forming the friction surface. The slat turning wheel 53 comprises a wheel shaft 531 and two circumferentially provided flanges 532. A front end of the joint interlocking mechanism 54 is fixedly connected between the two flanges 532 to form an eccentric connection so that a force moving the connecting push rod 55 upwardly and downwardly is converted into a force driving the slat turning wheel 53 to rotate. Furthermore, since the movable joints are bendable, when the slat turning wheel 53 is pushed to rotate, the joint member 541 can bend along with the rotation and abuts closely against the slat turning wheel 53, thereby easily bringing the slat turning wheel 53 to rotate clockwise (or counterclockwise) to a desired angle. In this embodiment, the slat turning wheel 53 can rotate beyond 180° so that slats 21 can abut against one another more tightly. Furthermore, when the joint member 541 bends and abuts against the slat turning wheel 53, the frictional surface on the inner side of the moveable joint can increase the frictional force between the two, thereby making operations labor-saving.

The slat turning member comprises a roller seat 57 and a turning roller 58, wherein the roller seat 57 is fixed in the frame 3 beam, the turning roller 58 is rotatably mounted on the roller seat 57 and closely fitted with and fixedly connected to a horizontal rotation shaft 56, and the turning cord 22, which passes through the roller seat 57, is wound around the turning roller 58 and cooperates with the turning roller 58.

The above louver lift mechanism 4 comprises: a lift traction member comprising a lift traction magnet inner slide assembly 41 and a lift traction magnet outer slide assembly 42, wherein the lift traction magnet inner slide assembly 41 is disposed in the frame 3 column and a rotatable wheel is provided at a top portion thereof, the lift traction magnet outer slide assembly 42 is provided outside the frame 3 column and located corresponding to and cooperating with the lift traction magnet inner slide assembly 41; a lift pull cord positioning member 43 comprising an "L"-shaped seat and a cover, wherein the "L"-shaped seat is disposed in the frame 3 column and above the lift traction magnet inner slide assembly 41, and the cover is firmly connected to the "L"-shaped seat via screws; a lift pull cord 44, of which one end is wound and fixed to the lift pull cord positioning member 43, and the other end passes in turn through each of the blades 21 after winding around the rotatable wheel of the lift traction magnet inner slide assembly 41, a first rolling bearing assembly 47 disposed at a corner portion of the frame and a second rolling bearing assembly 47 disposed in the roller seat 57 in turn. At the bottom of the lift traction magnet inner slide assembly 41 is provided a counterweight 45, and a counterweight bar is provided at a bottom end of the louver. A weight of the counterweight 45 is at least a sum of a weight of the counterweight bar and a weight of the slats. Preferably, a rolling bearing assembly 47 is disposed on a straight travel path and/or at a corner of the lift pull cord 44. The rolling bearing assembly 47 replaces the original rubber wheel and comprises a rolling pin and a ball bearing, or comprises a rolling pin, a ball bearing and a plastic bearing sleeve and exhibits a smaller friction co-efficient. Preferably, a wearable plastic stud 451 is disposed on the side of the counterweight 45 to reduce the friction between the counterweight 45 and an inside surface of the frame 3 column By improving these structures, the friction coefficient is reduced, the lift operation becomes more flexible and lighter, a service life is substantially prolonged, heavier louvers can be pulled, i.e., a larger area of louvers can be pulled, and the force for operation is greatly reduced. Therefore, the product turns out to be more practical, and the cost of the whole set of product is not increased much.

Figure 5:
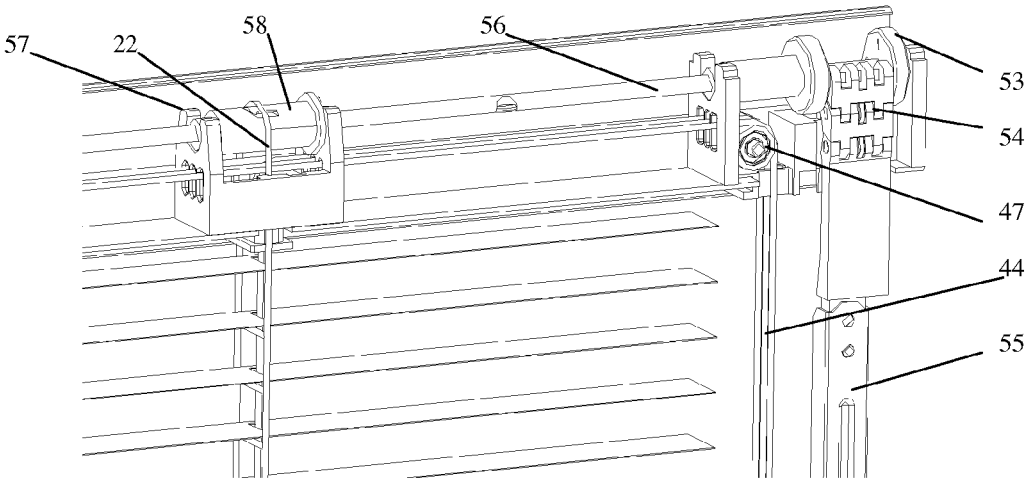
FIGS. 5-7 respectively show an embodiment of a state of a louver turning mechanism at positions where slats are horizontal, turned upwardly and turned downwardly.
Figure 6:
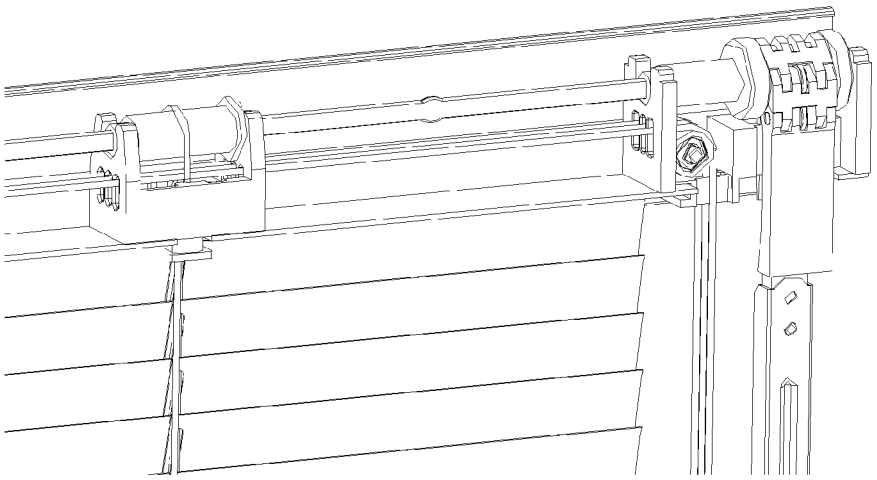
Figure 7:
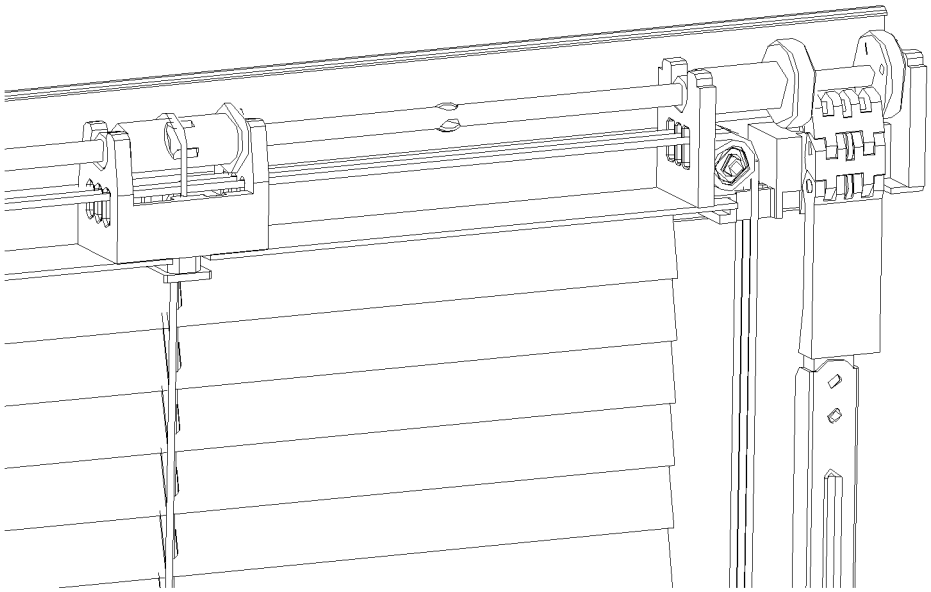

One working principle of an embodiment of a louver mechanism is as follows:

When the louver needs to be turned, the turn traction magnet outer slide assembly 52 is moved upwardly (or downwardly), bringing the turn traction magnet inner slide assembly 51 to synchronously move upwardly (or downwardly) therewith thereby pushing the connecting push rod 55 and the joint interlocking mechanism 54 to synchronously move upwardly (or downwardly). The moveable joint of the joint interlocking mechanism 54 during movement can bend along with the rotation of the slat turning wheel 53, thereby bringing the slat turning wheel 53 to rotate clockwise (or counterclockwise), thereby bringing the horizontal rotation shaft 56 and the turning roller 58 to rotate synchronously in the same direction, thereby bringing the turning cord 22 to swing inwardly (or outwardly), bringing the slats 21 to rotate a certain angle accordingly, and thereby achieving the purpose of shielding and adjusting sunlight. For example, in the embodiment, when the slats are in a upwardly turned state as shown in FIG. 6, the turn traction magnet outer slide assembly 52 is pulled downwardly, bringing the turn traction magnet inner slide assembly 51, the connecting push rod 55 and the joint interlocking mechanism 54 to move synchronously downwardly, bringing the slat turning wheel 53, the horizontal rotation shaft 56 and the turning roller 58 to synchronously rotate counterclockwise, thereby bringing the turning cord 22 to swing outwardly, bringing the slats 21 to rotate outwardly to a slat-horizontal state as shown in FIG. 5. Then the turn traction magnet outer slide assembly 52 is further pulled downwardly, and the slats 21 continue to rotate outwardly to a slats-downwardly-turned state as shown in FIG. 7, whereupon the slats rotate 180° so that the slats 21 can abut against one another more closely.

When the louver needs to be hoisted and lowered, the lift traction magnet outer slide assembly 42 is moved upwardly (or downwardly), bringing the lift traction magnet inner slide assembly 41 to synchronously move upwardly (or downwardly) therewith. Since the lift traction magnet inner slide assembly 41 functions like a movable pulley, while it rises (or falls), a portion of the lift pull cord 44 in the hollow glass will extend downwardly and become longer (or rise to become shorter), thereby achieving rise and fall of the slats 21. When the lift traction magnet inner slide assembly 41 falls to the counterweight 45 and attracts with a limiting magnet of a lower limiting block, the lift traction magnet inner slide assembly 41 will be attracted and positioned.

Embodiments of the improved louver mechanism are structurally more compact and reasonable. The louver can act more precisely and reliably and be turned at a larger angle so that the slats of the louver can abut against one another more closely. The louver exhibits advantages such as a closer abutment of slats, a better sunshade performance, a longer service life, stable and reliable use, unlikelihood to deformation and a light hand feeling in the slat-turning operation. Meanwhile, heavier slats can be turned so that a larger area of louver can be manufactured, whereby a limitation of area of the prior-art louver is broken through and hollow glass doors and windows can be further spread and used in more broad fields.

The present invention is not limited to the above embodiments. If various modification or variations to the present invention do not depart from the spirit and scope of the present invention, the present invention also intends to contain the various modifications and variations if they fall within the scope of claims of the present invention and equivalent technologies.

What is claimed is:

1. An improved louver turning mechanism, comprising;

a turn traction member, a turn transmission member and a slat turning member which are connected in turn;

wherein the turn transmission member comprises a slat turning wheel and a joint interlocking mechanism which are used in cooperation, the joint interlocking mechanism is, at one end thereof, eccentrically fixedly connected to the slat turning wheel to drive it to rotate, and, at the other end thereof, connected to the turn traction member through a connecting push rod;

wherein the slat turning wheel is coaxially fixedly connected to a horizontal rotation shaft of the slat turning member;

wherein the joint interlocking mechanism comprises more than one movable joint, and each of the more than one movable joints is comprised of two adjacent joint members;

wherein each of the two adjacent joint members have a convex portion and a concave portion, the convex portion of one of the two adjacent joint members is engaged with the concave portion of the other adjacent joint member, whereby the two adjacent joint members are hinged together via a pin.

2. The improved louver turning mechanism according to claim 1, wherein on an inner side of each of the more than one movable joints is provided with a frictional surface increasing a friction force when the inner side contacts with the slat turning wheel.

3. An improved hollow glass door or window with a built-in magnetically controllable louver, comprising two layers of glass, a louver sandwiched between the two layers of glass, and a frame sealing and connecting the two layers of glass, wherein a louver lift mechanism and a louver turning mechanism according to claim 2 is provided in the frame.

4. The improved louver turning mechanism according to claim 1, wherein the slat turning wheel comprises two circumferentially provided flanges, and an end of the joint interlocking mechanism is fixedly connected between the two flanges.

5. An improved hollow glass door or window with a built-in magnetically controllable louver, comprising two layers of glass, a louver sandwiched between the two layers of glass, and a frame sealing and connecting the two layers of glass, wherein a louver lift mechanism and a louver turning mechanism according to claim 4 is provided in the frame.

6. An improved hollow glass door or window with a built-in magnetically controllable louver, comprising two layers of glass, a louver sandwiched between the two layers of glass, and a frame sealing and connecting the two layers of glass, wherein a louver lift mechanism and a louver turning mechanism according to claim 1 is provided in the frame.

7. The improved hollow glass door or window with a built-in magnetically controllable louver according to claim 6, wherein the louver lift mechanism comprises a counterweight on one side of which a wearable plastic stud is disposed.

8. The improved hollow glass door or window with a built-in magnetically controllable louver according to claim 6, wherein the louver lift mechanism comprises a lift pull cord, and a rolling bearing assembly which is disposed on a straight travel path and/or at a corner of the lift pull cord.

9. The improved hollow glass door or window with a built-in magnetically controllable louver according to claim 8, wherein the rolling bearing assembly comprises a rolling pin and a ball bearing, or comprises a rolling pin, a ball bearing and a plastic bearing sleeve.

* * * * *